US012259129B2

(12) United States Patent
Zhang et al.

(10) Patent No.: US 12,259,129 B2
(45) Date of Patent: Mar. 25, 2025

(54) GRADED OXYGEN REGULATING, EXPLOSION PREVENTING AND RECYCLING SYSTEM AND METHOD FOR LIQUID NITROGEN WASH TAIL GAS

(71) Applicant: Kunming University of Science and Technology, Kunming (CN)

(72) Inventors: Qiulin Zhang, Kunming (CN); Ping Ning, Kunming (CN); Lianyun Gao, Kunming (CN); Jianjun Chen, Kunming (CN); Tianrun Shao, Kunming (CN)

(73) Assignee: Kunming University of Science and Technology, Kunming (CN)

( * ) Notice: Subject to any disclaimer, the term of this patent is extended or adjusted under 35 U.S.C. 154(b) by 776 days.

(21) Appl. No.: 17/398,531

(22) Filed: Aug. 10, 2021

(65) Prior Publication Data

US 2022/0341590 A1 Oct. 27, 2022

(30) Foreign Application Priority Data

Apr. 22, 2021 (CN) ..... 202110433331.4

(51) Int. Cl.
*F23G 7/07* (2006.01)
*F23C 13/04* (2006.01)
(Continued)

(52) U.S. Cl.
CPC ..... *F23G 7/07* (2013.01); *F23C 13/04* (2013.01); *F23K 1/00* (2013.01); *F28D 7/0066* (2013.01);
(Continued)

(58) Field of Classification Search
None
See application file for complete search history.

(56) References Cited

FOREIGN PATENT DOCUMENTS

CN 103486578 A 1/2014
CN 103769164 A 5/2014
(Continued)

OTHER PUBLICATIONS

Chinese communication, with English translation, dated Jul. 2, 2019 in corresponding Chinese patent application No. 201810666089.3.
(Continued)

*Primary Examiner* — Daniel Berns
(74) *Attorney, Agent, or Firm* — Nields, Lemack & Frame, LLC

(57) ABSTRACT

The present disclosure provides a graded oxygen regulating, explosion preventing and recycling system and method for liquid nitrogen wash tail gas, and relates to the technical field of environmental protection and energy utilization. The system provided by the present disclosure includes a multi section catalytic combustor, the multi-section catalytic combustor being divided into a first-section catalytic combustion region, a second-section catalytic combustion region, and a third-section catalytic combustion region, the first-section catalytic combustion region and the second-section catalytic combustion region being internally filled with multiple layers of catalysts that are disposed at intervals, and an air flow guide pipe being arranged above each layer of catalyst; a first-section heat exchanger communicating with the first-section catalytic combustion region; a second-section heat exchanger communicating with the second-section catalytic combustion region; a pulverized coal drying section communicating with the second-section heat exchanger; and a boiler section communicating with the third-section catalytic combustion region.

10 Claims, 1 Drawing Sheet

(51) Int. Cl.
*F23K 1/00* (2006.01)
*F28D 7/00* (2006.01)

(52) U.S. Cl.
CPC .... *F23G 2202/102* (2013.01); *F23G 2202/60* (2013.01); *F23G 2206/10* (2013.01); *F23G 2206/20* (2013.01); *F23K 2201/20* (2013.01)

(56) References Cited

FOREIGN PATENT DOCUMENTS

| | | | |
|---|---|---|---|
| CN | 106268740 | A | 1/2017 |
| CN | 107478732 | A | 12/2017 |
| CN | 107490012 | A | 12/2017 |
| CN | 109163338 | A | 1/2019 |
| CN | 110152660 | A | 8/2019 |

OTHER PUBLICATIONS

Chinese communication, with English translation, dated Sep. 30, 2019 in corresponding Chinese patent application No. 201810666089.3.

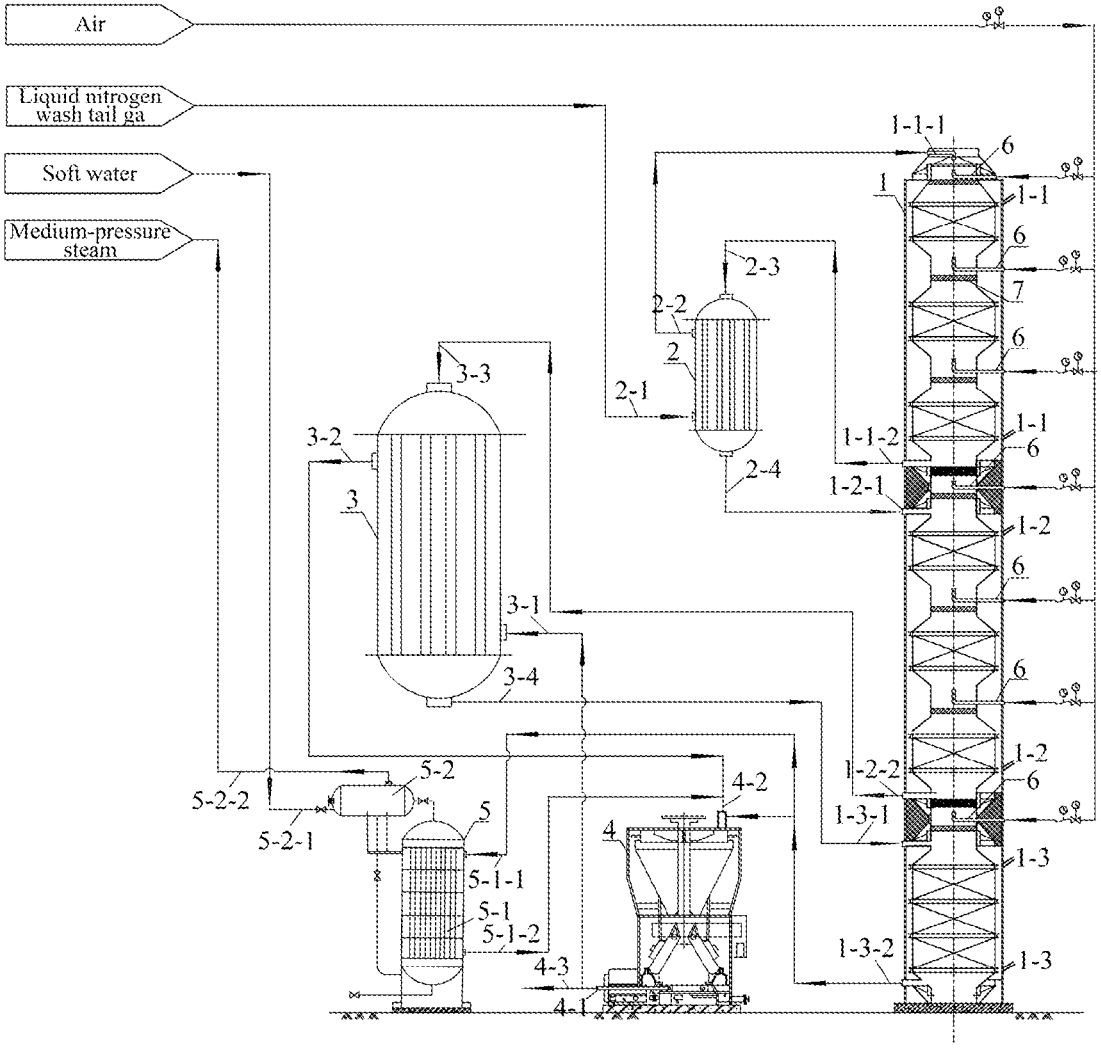
Air
Liquid nitrogen wash tail ga
Soft water
Medium-pressure steam
1-1-1
6
1
1-1
6
7
6
1-1
6
1-1-2
1-2-1
1-2
6
6
1-2
6
1-2-2
1-3-1
1-3
1-3-2
1-3
2-3
2-2
2
2-1
2-4
3-3
3-2
3
3-1
3-4
5-2
5-2-2
5-2-1
5
5-1-1
5-1
5-1-2
4-2
4
4-3
4-1

GRADED OXYGEN REGULATING, EXPLOSION PREVENTING AND RECYCLING SYSTEM AND METHOD FOR LIQUID NITROGEN WASH TAIL GAS

CROSS REFERENCE TO RELATED APPLICATION(S)

This patent application claims the benefit and priority of Chinese Patent Application No. 202110433331.4, filed on Apr. 22, 2021, the disclosure of which is incorporated by reference herein in its entirety as part of the present application.

TECHNICAL FIELD

The present disclosure relates to the technical field of environmental protection and energy utilization, in particular, a graded oxygen regulating, explosion preventing and recycling system and method for liquid nitrogen wash tail gas.

BACKGROUND ART

The use of a process for producing synthetic ammonia by pulverized coal gasification has an increasing proportion in production of synthetic ammonia by coal. However, a fine CO removal purification process for the synthetic gas after shifting uses liquid nitrogen as an absorbent to wash shifted gas, and CO and $CH_4$ in the shifted gas will be absorbed by the liquid nitrogen; and after cold energy recovery, gas that is discharged in a gaseous state is referred to as liquid nitrogen wash tail gas. The liquid nitrogen wash tail gas contains $CH_4$, CO, $H_2$ and $N_2$, and gas constituents are clean. Constituents in the liquid nitrogen wash tail gas are as shown in Table 1.

TABLE 1

| Constituents of liquid nitrogen washing tail gas | | | |
|---|---|---|---|
| Content of $H_2$ Vol % | Content of $N_2$ Vol % | Content of CO Vol % | Content of $CH_4$ Vol % |
| 1.6-1.9 | 80-85 | 3-8 | 0-0.4 |

It can be seen from Table 1 that the liquid nitrogen wash tail gas contains three combustible gases: $H_2$, $CH_4$ and CO and has a heat value of 1200 to 2250 kJ/$m^3$.

The liquid nitrogen wash tail gas cannot be directly used due to its low calorific value. In order to meet environmental protection requirements, a few enterprises deliver the liquid nitrogen wash tail gas into a thermoelectric boiler for co-combustion. However, the temperature of the liquid nitrogen wash tail gas is much lower than that of the boiler. Direct introduction into the boiler will take away the heat of the boiler and increase the power consumption of a fan. The heat is not recovered, and the thermal efficiency of the boiler is reduced. Therefore, most enterprises directly discharge the liquid nitrogen wash tail gas, which not only pollutes the environment, but also wastes energy. In addition, in the pulverized coal gasification process, coal needs to undergo grinding pulverization and inert drying before gasification. An enterprise mainly mixes high-temperature gas obtained after synthetic gas is combusted with nitrogen and delivers it to a coal mill as a dry heat source, resulting in great consumption of synthetic gas and high process operation cost. In response to this problem, the patent (CN201810666089.3) discloses a method and device for treating liquid nitrogen tail gas. Air is divided into three sections (an upper section, a middle section and a lower section) which are respectively mixed with the liquid nitrogen wash tail gas for catalytic combustion to produce low-pressure steam to realize recycling use of waste gas. However, practice finds that this method for treating the liquid nitrogen wash tail gas has great safety risk. There is great potential explosion hazard due to high temperature and large amount of air introduced. Furthermore, the patent can only produce low-pressure steam by use of exhaust gas in the middle section, so that the economic value is too low, and the value of heat cannot be highlighted. The temperature of exhaust gas at the outlets of the three sections is 400 to 420° C. for ground coal drying. There is a great potential safety hazard because pulverized coal has a spontaneous combustion hazard.

SUMMARY

In view of this, the present disclosure is directed to provide a graded oxygen regulating, explosion preventing and recycling system and method for liquid nitrogen wash tail gas. The system provided by the present disclosure can fully use and recycle heat to greatly increase the heat utilization rate, can also avoid the situation of non-uniform mixing of the liquid nitrogen wash tail gas and air to prevent explosion, and can avoid the hazard of spontaneous combustion of dry pulverized coal.

In order to achieve the foregoing invention objective, the present disclosure provides the following technical solution:

The present disclosure provides a graded oxygen regulating, explosion preventing and recycling system for liquid nitrogen wash tail gas, including:

- a multi-section catalytic combustor 1, wherein the multi-section catalytic combustor 1 includes a first-section catalytic combustion region 1-1, a second-section catalytic combustion region 1-2 and a third-section catalytic combustion region 1-3 which are disposed from top to bottom; the first-section catalytic combustion region 1-1 and the second-section catalytic combustion region 1-2 are each internally filled with multiple layers of catalysts; the number of layers of the catalysts is greater than or equal to 3, and the multiple layers of catalysts are disposed at intervals; an air flow guide pipe 6 is arranged above each layer of catalyst; the third-section catalytic combustion region 1-3 is internally filled with one layer of catalyst; an air flow guide pipe 6 is arranged above the catalyst of the third-section catalytic combustion region 1-3;
- a first-section heat exchanger 2 having a heat outlet 2-2 communicating with a top inlet 1-1-1 of the first-section catalytic combustion region 1-1, wherein a cold outlet 2-1 of the first-section heat exchanger 2 is a liquid nitrogen wash tail gas inlet; a heat inlet 2-3 of the first-section heat exchanger 2 communicates with a bottom outlet 1-1-2 of the first-section catalytic combustion region 1-1; a cold outlet 2-4 of the first-section heat exchanger 2 communicates with a top inlet 1-2-1 of the second-section catalytic combustion region 1-2;
- a second-section heat exchanger 3 having a heat inlet 3-3 communicating with a bottom outlet 1-2-2 of the second-section catalytic combustion region 1-2, wherein a cold outlet 3-4 of the second-section heat exchanger 3 communicates with a top inlet 1-3-1 of the third-section catalytic combustion region 1-3;

a pulverized coal drying section 4 having a low-temperature exhaust gas outlet 4-1 communicating with a cold inlet 3-1 of the second-section heat exchanger 3, wherein an exhaust gas discharge port 4-3 is also arranged between the low-temperature exhaust gas outlet 4-1 and the cold inlet 3-1; a hot exhaust gas inlet 4-2 of the pulverized coal drying section 4 communicates with a heat outlet 3-2 of the second-section heat exchanger 3; and a boiler section 5 having a heated gas inlet 5-1-1 communicating with a bottom outlet 1-3-2 of the third-section catalytic combustion region 1-3, wherein the boiler section 5 includes a boiler 5-1 and a steam pocket 5-2 communicating with the boiler 5-1; a heated gas outlet 5-1-2 of the boiler 5-1 communicates with the hot exhaust gas inlet 4-2 of the pulverized coal drying section 4; and the steam pocket 5-2 is also provided with a soft water inlet 5-2-1 and a steam outlet 5-2-2.

Preferably, the bottom outlet 1-3-2 of the third-section catalytic combustion region 1-3 also communicates with the hot exhaust gas inlet 4-2 of the pulverized coal drying section 4.

The present disclosure provides a graded oxygen regulating, explosion preventing and recycling method for liquid nitrogen wash tail gas, including the following steps:

(a) liquid nitrogen wash tail gas entering a first-section heat exchanger 2 through a cold inlet 2-1 for heat exchange with first-section high-temperature exhaust gas from a bottom outlet 1-1-2 of a first-section catalytic combustion region 1-1; after heat exchange, the liquid nitrogen wash tail gas entering a top inlet 1-1-1 of the first-section catalytic combustion region 1-1 through a heat outlet 2-2 and undergoing, in a layer-by-layer manner, first-section catalytic reaction on multiple layers of catalysts that are disposed in the first-section catalytic combustion region 1-1 at intervals to obtain first-section high-temperature exhaust gas, wherein in the process of layer-by-layer first-section catalytic reaction, the liquid nitrogen wash tail gas is mixed with air from an air flow guide pipe 6 above each layer of catalyst, and the first-section catalytic reaction is oxygen-deficient reaction;

(b) discharging the first-section high-temperature exhaust gas from the bottom outlet 1-1-2 of the first-section catalytic combustion region 1-1 to a first-section heat exchanger 2 through a heat inlet 2-3 for heat exchange; after the heat exchange, the first-section high-temperature exhaust gas entering a top inlet 1-2-1 of the second-section catalytic combustion region 1-2 through a cold outlet 2-4 of the first-section heat exchanger 2 and undergoing, in a layer-by-layer manner, second-section catalytic reaction on multiple layers of catalysts that are disposed in the second-section catalytic combustion region 1-2 at intervals to obtain second-section high-temperature exhaust gas, wherein in the process of layer-by-layer second-section catalytic reaction, the first-section high-temperature exhaust gas is mixed with air from the air flow guide pipe 6 above each layer of catalyst, and the second-section catalytic reaction is oxygen-deficient reaction;

(c) discharging the second-section high-temperature exhaust gas from a bottom outlet 1-2-2 of the second-section catalytic combustion region 1-2 to a second-section heat exchanger 3 through a heat inlet 3-3 for heat exchange with low-temperature exhaust gas discharged through a low-temperature exhaust gas outlet 4-1 of a pulverized coal drying section 4 in the second-section heat exchanger 3; after the heat exchange, discharging the low-temperature exhaust gas from a heat outlet 3-2 of the second-section heat exchanger 3 to the pulverized coal drying section 4 via a hot exhaust gas inlet 4-2, partially discharging the low-temperature exhaust gas through an exhaust gas discharge port 4-3; after the heat exchange, discharging the second-section high-temperature exhaust gas from a cold outlet 3-4 of the second-section heat exchanger 3 to a top inlet 1-3-1 of a third-section catalytic combustion region 1-3 for third-section catalytic reaction on a catalyst of the third-section catalytic combustion region 1-3 to obtain third-section high-temperature exhaust gas, wherein in the process of third-section catalytic reaction, the second-section high-temperature exhaust gas is mixed with air from the air flow guide pipe 6 above the catalyst of the third-section catalytic combustion region 1-3, and the third-section catalytic reaction is oxygen-rich reaction;

(d) discharging the third-section high-temperature exhaust gas from a bottom outlet 1-3-2 of the third-section catalytic combustion region 1-3 to a boiler 5-1 via a heated gas inlet 5-1-1, transferring heat to soft water in a steam pocket 5-2 through the boiler 5-1, and delivering out medium-pressure steam formed from the soft water for use, wherein after transferring the heat, the third-section high-temperature exhaust gas is discharged from a heated gas outlet 5-1-2 of the boiler 5-1 to the pulverized coal drying section 4 via the hot exhaust gas inlet 4-2.

Preferably, the third-section high-temperature exhaust gas enters the pulverized coal drying section 4 via the hot exhaust gas inlet 4-2 after being discharged from the bottom outlet 1-3-2 of the third-section catalytic combustion region 1-3.

Preferably, the volume content of $O_2$ in the first-section catalytic reaction and the second-section catalytic reaction is independently 0.4 to 0.9%.

Preferably, the temperature of the first-section high-temperature exhaust gas in the step (a) is 450 to 480° C., and the temperature of the liquid nitrogen wash tail gas rises to 230 to 240° C. after the heat exchange.

Preferably, the temperature of the first-section high-temperature exhaust gas after the heat exchange in the step (b) drops to 220 to 240° C., and the temperature of the second-section high-temperature exhaust gas is 450 to 480° C.

Preferably, the temperature of the low-temperature exhaust gas in the step (c) is 90 to 100° C.; the temperature of the low-temperature exhaust gas after the heat exchange rises to 150 to 180° C.; the temperature of the second-section high-temperature exhaust gas after the heat exchange drops to 300 to 350° C.; the temperature of the third-section high-temperature exhaust gas is 550 to 650° C.; and the volume content of $O_2$ in the third-section catalytic reaction is 3 to 4%.

Preferably, the temperature of the third-section high-temperature exhaust gas after the heat transfer in the step (d) drops to 250 to 300° C.

Preferably, the oxygen content in the pulverized coal drying section (4) in the step (c) and the step (d) is less than or equal to 3%, and the total content of CO and $H_2$ is less than 200 ppm.

The present disclosure provides a graded oxygen regulating, explosion preventing and recycling system for liquid nitrogen wash tail gas. The system provided by the present disclosure is divided into a heat exchange part, a catalytic combustion part and a recycling part. The heat exchange part is mainly that the liquid nitrogen wash tail gas in a first-section heat exchange and gas of a pulverized coal drying section in a second-section heat exchanger can be preheated for temperature rise. The catalytic combustion part is a multi-section catalytic combustor part that can enable the liquid nitrogen wash tail gas to undergo multi-stage catalytic combustion with multiple stages of air by splitting air into multiple stages, so as to avoid non-uniform mixing of the liquid nitrogen wash tail gas with the air and avoid an explosion risk. The recycling part is mainly that heat generated by each section of catalytic combustion region is exchanged and used. Particularly, the high-temperature exhaust gas generated in the third-section catalytic combustion region enters the boiler to transfer the heat to the soft water to produce medium-pressure steam with relatively high utilization value; the exhaust gas after the heat transfer can also enter the pulverized coal drying section to dry pulverized coal; and the temperature of the exhaust gas after the heat transfer decreases, so that the hazard of spontaneous combustion of the pulverized coal during drying of the pulverized coal by the high-temperature exhaust gas can be avoided while satisfying pulverized coal drying. The system provided by the present disclosure improves circulation and oxygen feeding methods of exhaust gas. Using the system to perform graded oxygen regulating, explosion preventing and recycling on the liquid nitrogen wash tail gas can use and recycle heat more efficiently and greatly increase the heat utilization rate, can also avoid non-uniform mixing of the liquid nitrogen wash tail gas with the air to prevent explosion, and can avoid the hazard of spontaneous combustion during drying of the pulverized coal. The present disclosure turns the liquid nitrogen wash tail gas into treasures, thus protecting the environment and achieving effects of saving energy and reducing emissions.

BRIEF DESCRIPTION OF THE DRAWINGS

FIG. 1 is a schematic diagram of a graded oxygen regulating, explosion preventing and recycling system for liquid nitrogen wash tail gas provided by the present disclosure. In FIG. 1, 1: multi-section catalytic combustor; 1-1: first-section catalytic combustion region; 1-1-1: top inlet of first-section catalytic combustion region; 1-1-2: bottom outlet of first-section catalytic combustion region; 1-2: second-section catalytic combustion region; 1-2-1: top inlet of second-section catalytic combustion region; 1-2-2: bottom outlet of second-section catalytic combustion region; 1-3: third-section catalytic combustion region; 1-3-1: top inlet of third-section catalytic combustion region; 1-3-2: bottom outlet of third-section catalytic combustion region; 2: first-section heat exchanger; 2-1: cold inlet of first-section heat exchanger; 2-2: heat outlet of first-section heat exchanger; 2-3: heat inlet of first-section heat exchanger; 2-4: cold outlet of first-section heat exchanger; 3: second-section heat exchanger; 3-1: cold inlet of second-section heat exchanger; 3-2: heat outlet of second-section heat exchanger; 3-3: heat inlet of second-section heat exchanger; 3-4: cold outlet of second-section heat exchanger; 4: pulverized coal drying section; 4-1: low-temperature exhaust gas outlet of pulverized coal drying section; 4-2: hot exhaust gas inlet of pulverized coal drying section; 4-3: exhaust gas discharge port; 5: boiler section; 5-1: boiler; 5-1-1: heated gas inlet of boiler section; 5-1-2: heated gas outlet of boiler; 5-2: steam pocket; 5-2-1: soft water inlet; 5-2-2: steam outlet; 6: air flow guide pipe; 7: exhaust gas flow guide plate.

DETAILED DESCRIPTION OF THE EMBODIMENTS

The present disclosure provides a graded oxygen regulating, explosion preventing and recycling system for liquid nitrogen wash tail gas, including:

- a multi-section catalytic combustor 1, wherein the multi-section catalytic combustor 1 includes a first-section catalytic combustion region 1-1, a second-section catalytic combustion region 1-2 and a third-section catalytic combustion region 1-3 which are disposed from top to bottom; the first-section catalytic combustion region 1-1 and the second-section catalytic combustion region 1-2 are each internally filled with multiple layers of catalysts; the number of layers of the catalysts is greater than or equal to 3, and the multiple layers of catalysts are disposed at intervals; an air flow guide pipe 6 is arranged above each layer of catalyst; the third-section catalytic combustion region 1-3 is internally filled with one layer of catalyst; an air flow guide pipe 6 is arranged above the catalyst of the third-section catalytic combustion region 1-3;
- a first-section heat exchanger 2 having a heat outlet 2-2 communicating with a top inlet 1-1-1 of the first-section catalytic combustion region 1-1, wherein a cold outlet 2-1 of the first-section heat exchanger 2 is a liquid nitrogen wash tail gas inlet; a heat inlet 2-3 of the first-section heat exchanger 2 communicates with a bottom outlet 1-1-2 of the first-section catalytic combustion region 1-1; a cold outlet 2-4 of the first-section heat exchanger 2 communicates with a top inlet 1-2-1 of the second-section catalytic combustion region 1-2;
- a second-section heat exchanger 3 having a heat inlet 3-3 communicating with a bottom outlet 1-2-2 of the second-section catalytic combustion region 1-2, wherein a cold outlet 3-4 of the second-section heat exchanger 3 communicates with a top inlet 1-3-1 of the third-section catalytic combustion region 1-3;
- a pulverized coal drying section 4 having a low-temperature exhaust gas outlet 4-1 communicating with a cold inlet 3-1 of the second-section heat exchanger 3, wherein an exhaust gas discharge port 4-3 is also arranged between the low-temperature exhaust gas outlet 4-1 and the cold inlet 3-1; a hot exhaust gas inlet 4-2 of the pulverized coal drying section 4 communicates with a heat outlet 3-2 of the second-section heat exchanger 3; and
- a boiler section 5 having a heated gas inlet 5-1-1 communicating with a bottom outlet 1-3-2 of the third-section catalytic combustion region 1-3, wherein the boiler section 5 includes a boiler 5-1 and a steam pocket 5-2 communicating with the boiler 5-1; a heated gas outlet 5-1-2 of the boiler 5-1 communicates with the hot exhaust gas inlet 4-2 of the pulverized coal drying section 4; and the steam pocket 5-2 is also provided with a soft water inlet 5-2-1 and a steam outlet 5-2-2.

The graded oxygen regulating, explosion preventing and recycling system for liquid nitrogen wash tail gas provided by the present disclosure is as shown in FIG. 1.

The graded oxygen regulating, explosion preventing and recycling system for liquid nitrogen wash tail gas provided by the present disclosure includes the multi-section catalytic combustor 1. The multi-section catalytic combustor 1 includes the first-section catalytic combustion region 1-1, the second-section catalytic combustion region 1-2 and the third-section catalytic combustion region 1-3 which are disposed from top to bottom. In the present disclosure, the first-section catalytic combustion region 1-1 and the second-section catalytic combustion region 1-2 are internally filled with multiple layers of catalysts. The number of layers of catalysts is greater than or equal to 3, and the multiple layers of catalysts are disposed at intervals. An air flow guide pipe 6 is arranged above each layer of catalyst. In the present disclosure, the multiple layers of catalysts in the first-section catalytic combustion region 1-1 and the second-section catalytic combustion region 1-2 respectively use the catalyst of the patent No. CN201610705294.7. In the present disclosure, a tower wall of the multi-section catalytic combustor 1 is preferably made of a heat-resistant stainless steel plate. Structures of each layer of catalyst in the first-section catalytic combustion region 1-1 and the second-section catalytic combustion region 1-2 are a fireproof bracket, a high-aluminum fireproof grating, a fireproof ball (having a thickness of 60 mm and a diameter of 20 to 30 mm), a stainless steel mesh and a catalyst from bottom to top. An exhaust gas flow guide plate (referring to 7 in FIG. 1) is also arranged above each layer of catalyst. The exhaust gas flow guide plate is preferably located below the air flow guide pipe 6. In the present disclosure, the multiple layers of catalysts are respectively arranged in the first-section catalytic combustion region 1-1 and the second-section catalytic combustion region 1-2 at intervals, and the air flow guide pipe is arranged above each layer of catalyst, so that the catalyst combustion degree of each layer can be different by controlling the air volume in each layer of catalyst to be different, so as to realize gradual temperature rise of the catalyst layers, avoid burning of the catalyst or reduction of the life of the catalyst due to a sudden temperature rise and also avoid non-uniform air mixing, and prevent occurrence of explosion. In the present disclosure, the specific number of layers of catalysts in the first-section catalytic combustion region 1-1 and the second-section catalytic combustion region 1-2 is determined by a heat value of the liquid nitrogen wash tail gas. In the embodiment of the present disclosure, three layers of catalysts are respectively arranged in the first-section catalytic combustion region 1-1 and the second-section catalytic combustion region 1-2 at intervals.

In the present disclosure, the third-section catalyst combustion region 1-3 is internally filled with one layer of catalyst, and an air flow guide pipe 6 is arranged above the catalyst of the third-section catalyst combustion region 1-3. In the present disclosure, the third-section catalyst combustion region 1-3 is a high-heat region. The catalyst of the third-section catalyst combustion region 1-3 uses the catalyst of the patent No. CN201910457896.9. The structure of the catalyst in the third-section catalyst combustion region 1-3 is the same as the above solution. Descriptions thereof are omitted here. What is different from the first-section catalytic combustion region 1-1 and the second-section catalytic combustion region 1-2 is that the inner wall of the third-section catalyst combustion region 1-3 is sequentially provided with an asbestos plate layer, a clay fireproof brick layer, a high-aluminum fireproof brick layer, and a clay fireproof brick. The thicknesses of the asbestos plate layer, the clay fireproof brick layer, the high-aluminum fireproof brick layer, and the clay fireproof brick are preferably 10 mm, 150 mm, 150 mm, and 150 mm respectively. The outer wall of the third-section catalyst combustion region 1-3 is preferably provided with a thermal insulation layer. The thickness of the thermal insulation layer is preferably 140 to 150 mm. A material of the thermal insulation layer is preferably expanded perlite.

In the present disclosure, all the air flow guide pipes 6 communicate with air pipelines. In the present disclosure, the air pipelines provide air required by catalytic combustion for various layers of catalysts by means of all the air flow guide pipes 6. Air valves are preferably provided between the air pipelines and the various air flow guide pipes 6. The air valves are favorable for regulating the volume of air entering each layer of catalyst.

In the present disclosure, the multi-section catalytic combustor 1 can enable the liquid nitrogen wash tail gas to undergo multi-stage catalytic combustion with the multiple stages of air by splitting air into multiple stages, so as to avoid non-uniform mixing of the liquid nitrogen wash tail gas with the air and avoid an explosion risk.

The graded oxygen regulating, explosion preventing and recycling system for liquid nitrogen wash tail gas provided by the present disclosure includes the first-section heat exchanger 2 having the heat outlet 2-2 communicating with the top inlet 1-1-1 of the first-section catalytic combustion region 1-1. In the present disclosure, the first-section heat exchanger 2 is used to make use of high-temperature exhaust gas generated by catalytic combustion of the liquid nitrogen wash tail gas via the first-section catalytic combustion region 1-1 to preheat the liquid nitrogen wash tail gas for temperature rise, thereby fully making use of the heat generated by the first-section catalytic combustion region 1-1.

The graded oxygen regulating, explosion preventing and recycling system for liquid nitrogen wash tail gas provided by the present disclosure includes the second-section heat exchanger 3 having the heat inlet 3-3 communicating with the bottom outlet 1-2-2 of the second-section catalytic combustion region 1-2. In the present disclosure, the second-section heat exchanger 3 is used to make use of the heat generated by the catalytic combustion of the second-section catalytic combustion region 1-2 to preheat the low-temperature exhaust gas discharged by the pulverized coal drying section for temperature rise, thereby fully making use of the heat of the second-section catalytic combustion region 1-2.

The graded oxygen regulating, explosion preventing and recycling system for liquid nitrogen wash tail gas provided by the present disclosure includes the pulverized coal drying section 4 having the low-temperature exhaust gas outlet 4-1 communicating with the cold inlet 3-1 of the second-section heat exchanger 3. The present disclosure has no special requirements for the structures of the pulverized coal drying section 4, as long as those skilled in the art know the corresponding structures. In the present disclosure, the hot exhaust gas inlet 4-2 of the pulverized coal drying section 4 communicates with the heat outlet 3-2 of the second-section heat exchanger 3. The low-temperature gas discharged by the pulverized coal drying section 4 can be re-provided to the pulverized coal drying section for recycling after temperature rise via the second-section heat exchanger 3.

The graded oxygen regulating, explosion preventing and recycling system for liquid nitrogen wash tail gas provided by the present disclosure includes the boiler section 5 having the heated gas inlet 5-1-1 communicating with the bottom outlet 1-3-2 of the third-section catalytic combustion region 1-3. In the present disclosure, the boiler section 5 includes the boiler 5-1 and the steam pocket 5-2 communicating with the boiler 5-1. There is no special requirements for a connection manner between the boiler 5-1 and the steam pocket 5-2. A connection manner that is familiar to those skilled in the art is used. In the present disclosure, the boiler section 5 is used to transfer the heat of the high-temperature exhaust gas generated by the third-section catalytic combustion region 1-3 to the soft water to produce medium-pressure steam with relatively high utilization value; the exhaust gas after the heat transfer can also enter the pulverized coal drying section to dry pulverized coal; and the temperature of the exhaust gas after the heat transfer decreases, so that the hazard of spontaneous combustion of the pulverized coal during drying of the pulverized coal by the high-temperature exhaust gas can be avoided while satisfying pulverized coal drying. In the present disclosure, when the temperature of the exhaust gas at the inlet of the pulverized coal drying section needs to further increase, the bottom outlet 1-3-2 of the third-section catalytic combustion region 1-3 also preferably communicates with the hot exhaust gas inlet 4-2 of the pulverized coal drying section 4, thereby fully making use of the heat of the third-section catalytic combustion region 1-3.

The system provided by the present disclosure improves circulation and oxygen feeding methods of exhaust gas. The heat can be used and recycled more efficiently to greatly increase the heat utilization rate, non-uniform mixing of the liquid nitrogen wash tail gas with the air can also be avoided to prevent explosion, and the hazard of spontaneous combustion during drying of the pulverized coal can be avoided.

The present disclosure provides a graded oxygen regulating, explosion preventing and recycling method for liquid nitrogen wash tail gas, including the following steps:

(a) liquid nitrogen wash tail gas enters a first-section heat exchanger 2 through a cold inlet 2-1 for heat exchange with first-section high-temperature exhaust gas from a bottom outlet 1-1-2 of a first-section catalytic combustion region 1-1; after heat exchange, the liquid nitrogen wash tail gas enters a top inlet 1-1-1 of the first-section catalytic combustion region 1-1 through a heat outlet 2-2 and undergoes, in a layer-by-layer manner, first-section catalytic reaction on multiple layers of catalysts that are disposed in the first-section catalytic combustion region 1-1 at intervals to obtain first-section high-temperature exhaust gas, wherein in the process of layer-by-layer first-section catalytic reaction, the liquid nitrogen wash tail gas is mixed with air from an air flow guide pipe 6 above each layer of catalyst, and the first-section catalytic reaction is oxygen-deficient reaction;

(b) the first-section high-temperature exhaust gas is discharged from the bottom outlet 1-1-2 of the first-section catalytic combustion region 1-1 to a first-section heat exchanger 2 through a heat inlet 2-3 for heat exchange; after the heat exchange, the first-section high-temperature exhaust gas enters a top inlet 1-2-1 of the second-section catalytic combustion region 1-2 through a cold outlet 2-4 of the first-section heat exchanger 2 and undergoes, in a layer-by-layer manner, second-section catalytic reaction on multiple layers of catalysts that are disposed in the second-section catalytic combustion region 1-2 at intervals to obtain second-section high-temperature exhaust gas, wherein in the process of layer-by-layer second-section catalytic reaction, the first-section high-temperature exhaust gas is mixed with air from the air flow guide pipe 6 above each layer of catalyst, and the second-section catalytic reaction is oxygen-deficient reaction;

(c) the second-section high-temperature exhaust gas is discharged from a bottom outlet 1-2-2 of the second-section catalytic combustion region 1-2 to a second-section heat exchanger 3 through a heat inlet 3-3 for heat exchange with low-temperature exhaust gas discharged through a low-temperature exhaust gas outlet 4-1 of a pulverized coal drying section 4 in the second-section heat exchanger 3; after the heat exchange, the low-temperature exhaust gas is discharged from a heat outlet 3-2 of the second-section heat exchanger 3 to the pulverized coal drying section 4 via a hot exhaust gas inlet 4-2, and the low-temperature exhaust gas is also partially discharged through an exhaust gas discharge port 4-3; after the heat exchange, the second-section high-temperature exhaust gas is discharged from a cold outlet 3-4 of the second-section heat exchanger 3 to a top inlet 1-3-1 of a third-section catalytic combustion region 1-3 for third-section catalytic reaction on a catalyst of the third-section catalytic combustion region 1-3 to obtain third-section high-temperature exhaust gas, wherein in the process of third-section catalytic reaction, the second-section high-temperature exhaust gas is mixed with air from the air flow guide pipe 6 above the catalyst of the third-section catalytic combustion region 1-3, and the third-section catalytic reaction is oxygen-rich reaction;

(d) the third-section high-temperature exhaust gas is discharged through a bottom outlet 1-3-2 of the third-section catalytic combustion region 1-3 to a boiler 5-1 via a heated gas inlet 5-1-1, heat is transferred to soft water in a steam pocket 5-2 through the boiler 5-1, and medium-pressure steam formed from the soft water is delivered out for use, wherein after transferring the heat, the third-section high-temperature exhaust gas is discharged from a heated gas outlet 5-1-2 of the boiler 5-1 to the pulverized coal drying section 4 via the hot exhaust gas inlet 4-2.

In the present disclosure, the liquid nitrogen wash tail gas enters the first-section heat exchanger 2 through the cold inlet 2-1 for heat exchange with the first-section high-temperature exhaust gas from the bottom outlet 1-1-2 of the first-section catalytic combustion region 1-1; after the heat exchange, the liquid nitrogen wash tail gas enters the top inlet 1-1-1 of the first-section catalytic combustion region 1-1 through the heat outlet 2-2 and undergoes, in the layer-by-layer manner, the first-section catalytic reaction on the multiple layers of catalysts that are disposed in the first-section catalytic combustion region 1-1 at intervals to obtain the first-section high-temperature exhaust gas. Preferably, the temperature of the first-section high-temperature exhaust gas is preferably 450 to 480° C., and the temperature of the liquid nitrogen wash tail gas preferably rises from normal temperature to 230 to 240° C. after the heat exchange. In the present disclosure, in the process of layer-by-layer first-section catalytic reaction, the liquid nitrogen wash tail gas is mixed with the air from the air flow guide pipe 6 above each layer of catalyst. In the embodiment of the present disclosure, three layers of catalysts are disposed in the first-section catalytic combustion region 1-1 at intervals. Therefore, the first-section catalytic reaction includes first-stage catalytic reaction, second-stage catalytic reaction and third-stage catalytic reaction. Specifically processes of the first-stage catalytic reaction, the second-stage catalytic reaction and the third-stage catalytic reaction are preferably as follows: after the heat exchange, the liquid nitrogen wash tail gas enters the top inlet 1-1-1 of the first-section catalytic combustion region 1-1 and is mixed with the first-stage air that enters the position above the first layer of catalyst of the first-section catalytic combustion region 1-1 via the air flow guide pipe for the first-stage catalytic reaction at the position of the first layer of catalyst to obtain first-stage reaction gas. The first-stage reaction gas is then mixed with the second-stage air that enters the position above the second layer of catalyst of the first-section catalytic combustion region 1-1 via the air flow guide pipe and enters the position of the second layer of catalyst via the exhaust gas flow guide plate for the second-stage catalytic reaction to obtain second-stage reaction gas. The second-stage reaction gas is then mixed with the third-stage air that enters the position above the third layer of catalyst of the first-section catalytic combustion region 1-1 via the air flow guide pipe and enters the position of the third layer of catalyst via the exhaust gas flow guide plate for the third-stage catalytic reaction to obtain first-section high-temperature exhaust gas. In the present disclosure, the first-section catalytic reaction is oxygen-deficient reaction. The volume content of $O_2$ of the first-section catalytic reaction is preferably 0.4 to 0.9%. In the present disclosure, the volume contents of $O_2$ of the first-stage catalytic reaction, the second-stage catalytic reaction and the third-stage catalytic reaction in the first-section catalytic reaction are further preferably 0.4 to 0.5%, 0.6 to 0.7% and 0.8 to 0.9% respectively. The temperatures of the first-stage catalytic reaction, the second-stage catalytic reaction and the third-stage catalytic reaction in the first-section catalytic reaction are preferably 200 to 230° C., 340 to 360° C. and 450 to 480° C. respectively.

After the first-section high-temperature exhaust gas is obtained, in the present disclosure, the first-section high-temperature exhaust gas is discharged from the bottom outlet 1-1-2 of the first-section catalytic combustion region 1-1 to the first-section heat exchanger 2 through the heat inlet 2-3 for heat exchange; after the heat exchange, the first-section high-temperature exhaust gas enters the top inlet 1-2-1 of the second-section catalytic combustion region 1-2 through the cold outlet 2-4 of the first-section heat exchanger 2 and undergoes, in the layer-by-layer manner, the second-section catalytic reaction on the multiple layers of catalysts that are disposed in the second-section catalytic combustion region 1-2 at intervals to obtain the second-section high-temperature exhaust gas. In the present disclosure, the temperature of the first-section high-temperature exhaust gas after the heat exchange preferably drops to 220 to 240° C., and the temperature of the second-section high-temperature exhaust gas is 450 to 480° C. In the present disclosure, in the process of layer-by-layer second-section catalytic reaction, the first-section high-temperature exhaust gas is mixed with the air from the air flow guide pipe 6 above each layer of catalyst. In the embodiment of the present disclosure, three layers of catalysts are arranged in the second-section catalytic combustion 1-2 at intervals. Therefore, the second-section catalytic reaction includes a fourth-stage catalytic reaction, a fifth-stage catalytic reaction, and a sixth-stage catalytic reaction which are performed in sequence. Specific reaction forms of the fourth-stage catalytic reaction, the fifth-stage catalytic reaction, and the sixth-stage catalytic reaction are the same as the specific reaction forms of the first-stage catalytic reaction, a second-stage catalytic reaction, and a third-stage catalytic reaction, and descriptions thereof are omitted here. In the present disclosure, the second-section catalytic reaction is oxygen-deficient reaction. The volume content of $O_2$ of the second-section catalytic reaction is preferably 0.4 to 0.9%. In the embodiment of the present disclosure, the volume contents of $O_2$ of the fourth-stage catalytic reaction, the fifth-stage catalytic reaction and the sixth-stage catalytic reaction in the second-section catalytic reaction are further preferably 0.4 to 0.5%, 0.6 to 0.7% and 0.8 to 0.9% respectively. The temperatures of the fourth-stage catalytic reaction, the fifth-stage catalytic reaction and the sixth-stage catalytic reaction in the first-section catalytic reaction are preferably 200 to 230° C., 340 to 360° C. and 450 to 480° C. respectively.

In the present disclosure, the oxygen-deficient reaction is firstly performed in the first-section catalytic combustion 1-1 and the second-section catalytic combustion 1-2 to avoid burnout of the catalytic combustor due to an extremely high temperature caused by a large amount of heat released at the beginning of the reaction and avoid phenomena of non-uniform mixing and explosion easily caused by directly mixing the liquid nitrogen wash tail gas with a lot of oxygen.

After the second-section high-temperature exhaust gas is obtained, in the present disclosure, the second-section high-temperature exhaust gas is discharged from the bottom outlet 1-2-2 of the second-section catalytic combustion region 1-2 to the second-section heat exchanger 3 through the heat inlet 3-3 for heat exchange with the low-temperature exhaust gas discharged from the low-temperature exhaust gas outlet 4-1 of the pulverized coal drying section 4 in the second-section heat exchanger 3; after the heat exchange, the low-temperature exhaust gas is discharged from the heat outlet 3-2 of the second-section heat exchanger 3 to the pulverized coal drying section 4 via the hot exhaust gas inlet 4-2, and the low-temperature exhaust gas is also partially discharged through an exhaust gas discharge port 4-3; after the heat exchange, the second-section high-temperature exhaust gas is discharged from the cold outlet 3-4 of the second-section heat exchanger 3 to the top inlet 1-3-1 of the third-section catalytic combustion region 1-3 for third-section catalytic reaction on the catalyst of the third-section catalytic combustion region 1-3 to obtain the third-section high-temperature exhaust gas. In the present disclosure, the temperature of the low-temperature exhaust gas is preferably 90 to 100° C.; the temperature of the low-temperature exhaust gas after the heat exchange preferably rises to 150 to 180° C.; and the temperature of the second-section high-temperature exhaust gas after the heat exchange drops to 300 to 350° C. In the present disclosure, in the process of the third-section catalytic reaction, the second-section high-temperature exhaust gas is mixed with the air from the air flow guide pipe 6 above the third-section catalytic combustion region 1-3. Since the third-section catalytic combustion region is internally filled with one layer of catalyst, the third-section catalytic reaction is one-stage catalytic reaction. In the embodiment of the present disclosure, the third-section catalytic reaction is specifically seventh-stage catalytic reaction. In the present disclosure, the third-section catalytic reaction is oxygen-rich reaction. The volume content of $O_2$ of the third-section catalytic reaction is preferably 3 to 4% (a volume ratio of the liquid nitrogen wash tail gas to the air is 1:(0.16 to 0.2)), and the temperature of the third-section high-temperature exhaust gas is preferably 550 to 650° C.

After the third-section high-temperature exhaust gas is obtained, the third-section high-temperature exhaust gas through a bottom outlet 1-3-2 of the third-section catalytic combustion region 1-3 to a boiler 5-1 via a heated gas inlet 5-1-1, transferring heat to soft water in a steam pocket 5-2 through the boiler 5-1, and delivering out medium-pressure steam formed from the soft water for use, wherein after transferring the heat, the third-section high-temperature exhaust gas is discharged from a heated gas outlet 5-1-2 of the boiler 5-1 to the pulverized coal drying section 4 via the hot exhaust gas inlet 4-2. In the present disclosure, every 10000 $m^3$ of liquid nitrogen wash tail gas can produce 1400 to 1500 kg of 1.6 MPa medium-pressure steam (according to HG/T 20521-1992 Provisions for Design of Chemical Steam System, low-pressure steam is generally 1.57 MPa or below, and medium-pressure steam is 1.58 to 3.82 MPa), achieving outstanding economic benefits. In the present disclosure, the temperature of the third-section high-temperature exhaust gas after the heat transfer preferably drops to 250 to 300° C. The exhaust gas at the temperature supplies heat to the pulverized coal drying section 4, so that the working condition requirements of the pulverized coal drying section can be met, and the hazard of spontaneous combustion of the pulverized coal caused by using extremely high exhaust gas temperature to dry the pulverized coal can also be avoided. In the present disclosure, when the temperature of the exhaust gas at the inlet of the pulverized coal drying section 4 needs to be further increased, the third-section high-temperature exhaust gas preferably enters the pulverized coal drying section 4 via the hot exhaust gas inlet 4-2 after being discharged from the bottom outlet 1-3-2 of the third-section catalytic combustion region 1-3.

In the present disclosure, the oxygen content in the pulverized coal drying section 4 is less than or equal to 3%, and the total content of CO and $H_2$ is preferably less than 200 ppm to prevent explosion.

The graded oxygen regulating, explosion preventing and recycling system and method for liquid nitrogen wash tail gas provided by the present disclosure are described in detail below in combination with the embodiments, but are not understood as limiting the protection scope of the present disclosure.

Embodiment 1

A graded oxygen regulating, explosion preventing and recycling system for liquid nitrogen wash tail gas, as shown in FIG. 1, includes a multi-section catalytic combustor 1, a first-section heat exchanger 2, a second-section heat exchanger 3, a pulverized coal drying section 4, and a boiler section 5. The multi-section catalytic combustor 1 is divided into a first-section catalytic combustion region 1-1, a second-section catalytic combustion region 1-2, and a third-section catalytic combustion region 1-3. The first-section catalytic combustion region 1-1 and the second-section catalytic combustion region 1-2 are internally filled with three layers of catalysts (selected from the catalyst prepared in Embodiment 1 in the patent CN201610705294.7) that are disposed at intervals, and an air flow guide pipe is arranged above each layer of catalyst. The third-section catalytic combustion region 1-3 is internally filled with one layer of catalyst (selected from the catalyst prepared in Embodiment 1 in the patent CN201910457896.9), and an air flow guide pipe is arranged above the catalyst of the third-section catalytic combustion region 1-3.

Constituents (Vol %) of the liquid nitrogen wash tail gas to be treated: 1.8% of $H_2$, 7% of CO, and 84.82% of $N_2$. The treatment volume of the liquid nitrogen wash tail gas is 30000 $Nm^3/h$.

The liquid nitrogen wash tail gas is treated by using the system shown in FIG. 1, and a process is as follows:

The liquid nitrogen wash tail gas at 30000 $Nm^3/h$ enters the first-section heat exchanger 2 through the cold inlet 2-1 for heat exchange with the first-section high-temperature exhaust gas at 450 to 480° C. from the bottom outlet 1-1-2 of the first-section catalytic combustion region 1-1; after the heat exchange, when the temperature of the liquid nitrogen wash tail gas rises up from the normal temperature to 230 to 240° C., the liquid nitrogen wash tail gas enters the top inlet 1-1-1 of the first-section catalytic combustion region 1-1 through the heat outlet 2-2 and undergoes the first-stage catalytic reaction, the second-stage catalytic reaction and the third-stage catalytic reaction in sequence on the three layers of catalysts that are disposed in the first-section catalytic combustion region 1-1 at intervals to obtain the first-section high-temperature exhaust gas. Specifically, the air flow of the multi-section catalytic combustor is regulated by means of controlling the air valves; after the heat exchange, the liquid nitrogen wash tail gas with the temperature of 230 to 240° C. is uniformly mixed with the first-stage air that enters the position above the first layer of catalyst of the first-section catalytic combustion region 1-1 via the air flow guide pipe and has a flow rate of 714 $m^3/h$ for first-stage catalytic reaction at the position of the first layer of catalyst at a reaction temperature of 200 to 230° C. to obtain first-stage reaction gas; the first-stage reaction gas is then uniformly mixed with second-stage air that enters the position above the second layer of catalyst of the first-section catalytic combustion region 1-1 via the air flow guide pipe and has a flow rate of 1000 $m^3/h$, and enters the position of the second layer of catalyst via an exhaust gas flow guide plate for second-stage catalytic reaction at a reaction temperature of 340 to 360° C. to obtain second-stage reaction gas; and the second-stage reaction gas is then uniformly mixed with third-stage air that enters the position above the third layer of catalyst of the first-section catalytic combustion region 1-1 via the air flow guide pipe and has a flow rate of 1286 $m^3/h$, and enters the position of the third layer of catalyst via the exhaust gas flow guide plate for third-stage catalytic reaction to obtain first-section high-temperature exhaust gas with a temperature of 450 to 480° C.

The first-section high-temperature exhaust gas that is partially combusted for the first time is discharged from a bottom outlet 1-1-2 of the first-section catalytic combustion region 1-1 to the first-section heat exchanger 2 through the heat inlet 2-3 for heat exchange; after the heat exchange, when the temperature of the first-section high-temperature exhaust gas drops to 220 to 230° C., the first-section high-temperature exhaust gas enters the top inlet 1-2-1 of the second-section catalytic combustion region 1-2 through the cold outlet 2-4 of the first-section heat exchanger 2 and undergoes the fourth-stage catalytic reaction, the fifth-stage catalytic reaction and the sixth-stage catalytic reaction in sequence on the three layers of catalysts that are disposed in the second-section catalytic combustion region 1-2 at intervals to obtain the second-section high-temperature exhaust gas. Specifically, after the heat exchange, the first-section high-temperature exhaust gas with the temperature of 220 to 230° C. is uniformly mixed with the fourth-stage air that enters the position above the first layer of catalyst of the second-section catalytic combustion region 1-2 via the air flow guide pipe and has a flow rate of 714 $m^3/h$, and enters the position of the first layer of catalyst via the exhaust gas flow guide plate for fourth-stage catalytic reaction at a reaction temperature of 200 to 230° C. to obtain fourth-stage reaction gas; the fourth-stage reaction gas is then uniformly mixed with fifth-stage air that enters the position above the second layer of catalyst of the second-section catalytic combustion region 1-2 via the air flow guide pipe and has a flow rate of 1000 $m^3/h$, and enters the position of the second layer of catalyst via the exhaust gas flow guide plate for fifth-stage catalytic reaction at a reaction temperature of 340 to 360° C. to obtain fifth-stage reaction gas; and the fifth-stage reaction gas is then uniformly mixed with sixth-stage air that enters the position above the third layer of catalyst of the second-section catalytic combustion region 1-2 via the air flow guide pipe and has a flow rate of 1286 $m^3/h$, and enters the position of the third layer of catalyst via the exhaust gas flow guide plate for sixth-stage catalytic reaction to obtain second-section high-temperature exhaust gas with a temperature of 450 to 480° C.

The second-section high-temperature exhaust gas that is partially combusted for the second time is discharged from a bottom outlet 1-2-2 of the second-section catalytic combustion region 1-2 to the second-section heat exchanger 3 through a heat inlet 3-3 for heat exchange; after the heat exchange, when the temperature of the second-section high-temperature exhaust gas drops to 300 to 330° C., the second-section high-temperature exhaust gas is discharged from a cold outlet 3-4 of the second-section heat exchanger 3 to a top inlet 1-3-1 of the third-section catalytic combustion region 1-3, is uniformly mixed with the air that enters the position above the catalyst of the third-section catalytic combustion region 1-3 via the air flow guide pipe and has a flow rate of 4286 $m^3$/h, and enters the position of the catalyst via the exhaust gas flow guide plate for seventh-stage catalytic reaction to obtain third-section high-temperature exhaust gas with a temperature of 550 to 650° C.

The third-section high-temperature exhaust gas with the temperature of 550 to 650° C. is discharged from a bottom outlet 1-3-2 of the third-section catalytic combustion region 1-3 to a boiler 5-1 via a heated gas inlet 5-1-1, and heat is transferred to soft water in a steam pocket 5-2 through the boiler 5-1 to produce medium-pressure steam of 1680 to 1800 kg/h for delivery for use; after the heat transfer, the temperature of the third-section high-temperature exhaust gas drops to 250 to 300° C., and the third-section high-temperature exhaust gas is discharged from a heated gas outlet 5-1-2 of the boiler 5-1 to the pulverized coal drying section 4 through a hot exhaust gas inlet 4-2 to dry pulverized coal; the temperature of the exhaust gas at the outlet of the pulverized coal drying section 4 is 90° C., and the exhaust gas volume is 100000 $Nm^3$/h; exhaust gas of 30000 $Nm^3$/h is discharged, and exhaust gas of 70000 $Nm^3$/h enters the second-section heat exchanger 3 for heat exchange till 160° C., and then enters the pulverized coal drying section 4 through the hot exhaust gas inlet 4-2 for recycling together with the third-section high-temperature exhaust gas having the temperature decreasing to 250 to 300° C. after the heat transfer.

Embodiment 2

A graded oxygen regulating, explosion preventing and recycling system for liquid nitrogen wash tail gas, as shown in FIG. 1, includes a multi-section catalytic combustor 1, a first-section heat exchanger 2, a second-section heat exchanger 3, a pulverized coal drying section 4, and a boiler section 5. The multi-section catalytic combustor 1 is divided into a first-section catalytic combustion region 1-1, a second-section catalytic combustion region 1-2, and a third-section catalytic combustion region 1-3. The first-section catalytic combustion region 1-1 and the second-section catalytic combustion region 1-2 are internally filled with three layers of catalysts (the catalysts are the same as in Embodiment 1) that are disposed at intervals, and an air flow guide pipe is arranged above each layer of catalyst. The third-section catalytic combustion region 1-3 is internally filled with one layer of catalyst (the catalyst is the same as in Embodiment 1), and an air flow guide pipe is arranged above the catalyst of the third-section catalytic combustion region 1-3.

Constituents (Vol %) of the liquid nitrogen wash tail gas to be treated: 1.7% of $H_2$, 6% of CO, and 92.3% of $N_2$. The treatment volume of the liquid nitrogen wash tail gas is 90000 $Nm^3$/h.

The liquid nitrogen wash tail gas is treated by using the system shown in FIG. 1, and a process is as follows:

The liquid nitrogen wash tail gas at 90000 $Nm^3$/h enters the first-section heat exchanger 2 through the cold inlet 2-1 for heat exchange with the first-section high-temperature exhaust gas at 450 to 460° C. from the bottom outlet 1-1-2 of the first-section catalytic combustion region 1-1; after the heat exchange, when the temperature of the liquid nitrogen wash tail gas rises up from the normal temperature to 230 to 240° C., the liquid nitrogen wash tail gas enters the top inlet 1-1-1 of the first-section catalytic combustion region 1-1 through the heat outlet 2-2 and undergoes the first-stage catalytic reaction, the second-stage catalytic reaction and the third-stage catalytic reaction in sequence on the three layers of catalysts that are disposed in the first-section catalytic combustion region 1-1 at intervals to obtain the first-section high-temperature exhaust gas. Specifically, the air flow of the multi-section catalytic combustor is regulated by means of controlling the air valves; after the heat exchange, the liquid nitrogen wash tail gas with the temperature of 230 to 240° C. is uniformly mixed with the first-stage air that enters the position above the first layer of catalyst of the first-section catalytic combustion region 1-1 via the air flow guide pipe and has a flow rate of 2143 $m^3$/h for first-stage catalytic reaction at the position of the first layer of catalyst at a reaction temperature of 200 to 220° C. to obtain first-stage reaction gas; the first-stage reaction gas is then uniformly mixed with second-stage air that enters the position above the second layer of catalyst of the first-section catalytic combustion region 1-1 via the air flow guide pipe and has a flow rate of 3000 $m^3$/h, and enters the position of the second layer of catalyst via an exhaust gas flow guide plate for second-stage catalytic reaction at a reaction temperature of 340 to 350° C. to obtain second-stage reaction gas; and the second-stage reaction gas is then uniformly mixed with third-stage air that enters the position above the third layer of catalyst of the first-section catalytic combustion region 1-1 via the air flow guide pipe and has a flow rate of 3857 $m^3$/h, and enters the position of the third layer of catalyst via the exhaust gas flow guide plate for third-stage catalytic reaction to obtain first-section high-temperature exhaust gas with a temperature of 450 to 460° C.

The first-section high-temperature exhaust gas that is partially combusted for the first time is discharged from a bottom outlet 1-1-2 of the first-section catalytic combustion region 1-1 to the first-section heat exchanger 2 through the heat inlet 2-3 for heat exchange; after the heat exchange, when the temperature of the first-section high-temperature exhaust gas drops to 220 to 240° C., the first-section high-temperature exhaust gas enters the top inlet 1-2-1 of the second-section catalytic combustion region 1-2 through the cold outlet 2-4 of the first-section heat exchanger 2 and undergoes the fourth-stage catalytic reaction, the fifth-stage catalytic reaction and the sixth-stage catalytic reaction in sequence on the three layers of catalysts that are disposed in the second-section catalytic combustion region 1-2 at intervals to obtain the second-section high-temperature exhaust gas. Specifically, after the heat exchange, the first-section high-temperature exhaust gas with the temperature of 220 to 240° C. is uniformly mixed with the fourth-stage air that enters the position above the first layer of catalyst of the second-section catalytic combustion region 1-2 via the air flow guide pipe and has a flow rate of 2143 $m^3$/h, and enters the position of the first layer of catalyst via the exhaust gas flow guide plate for fourth-stage catalytic reaction at a reaction temperature of 200 to 220° C. to obtain fourth-stage reaction gas; the fourth-stage reaction gas is then uniformly mixed with fifth-stage air that enters the position above the second layer of catalyst of the second-section catalytic combustion region 1-2 via the air flow guide pipe and has a flow rate of 3000 $m^3/h$, and enters the position of the second layer of catalyst via the exhaust gas flow guide plate for fifth-stage catalytic reaction at a reaction temperature of 340 to 350° C. to obtain fifth-stage reaction gas; and the fifth-stage reaction gas is then uniformly mixed with sixth-stage air that enters the position above the third layer of catalyst of the second-section catalytic combustion region 1-2 via the air flow guide pipe and has a flow rate of 3857 $m^3/h$, and enters the position of the third layer of catalyst via the exhaust gas flow guide plate for sixth-stage catalytic reaction to obtain second-section high-temperature exhaust gas with a temperature of 450 to 460° C.

The second-section high-temperature exhaust gas that is partially combusted for the second time is discharged from a bottom outlet 1-2-2 of the second-section catalytic combustion region 1-2 to the second-section heat exchanger 3 through a heat inlet 3-3 for heat exchange; after the heat exchange, when the temperature of the second-section high-temperature exhaust gas drops to 300 to 350, the second-section high-temperature exhaust gas is discharged from a cold outlet 3-4 of the second-section heat exchanger 3 to a top inlet 1-3-1 of the third-section catalytic combustion region 1-3, is uniformly mixed with the air that enters the position above the catalyst of the third-section catalytic combustion region 1-3 via the air flow guide pipe and has a flow rate of 12857 $m^3/h$, and enters the position of the catalyst via the exhaust gas flow guide plate for seventh-stage catalytic reaction to obtain third-section high-temperature exhaust gas with a temperature of 550 to 650° C.

The third-section high-temperature exhaust gas with the temperature of 550 to 650° C. is discharged from a bottom outlet 1-3-2 of the third-section catalytic combustion region 1-3, and 70% of the third-section high-temperature exhaust gas enters a boiler 5-1 via a heated gas inlet 5-1-1, and heat is transferred to soft water in a steam pocket 5-2 through the boiler 5-1 to produce medium-pressure steam of 2646 to 2835 kg/h for delivery for use; the temperature of this part of third-section high-temperature exhaust gas after the heat transfer drops to 250 to 300° C., and the third-section high-temperature exhaust gas is discharged from a heated gas outlet 5-1-2 of the boiler 5-1 to the pulverized coal drying section 4 through a hot exhaust gas inlet 4-2 to dry pulverized coal; the other 30% of third-section high-temperature exhaust gas enters the pulverized coal drying section through the hot exhaust gas inlet 4-2; the temperature of the exhaust gas at the outlet of the pulverized coal drying section 4 is 90° C., and the exhaust gas volume is 300000 $Nm^3/h$; exhaust gas of 30000 $Nm^3/h$ is discharged, and exhaust gas of 270000 $Nm^3/h$ enters the second-section heat exchanger 3 for heat exchange till 180° C., and then enters the pulverized coal drying section 4 through the hot exhaust gas inlet 4-2 for recycling together with the third-section high-temperature exhaust gas having the temperature decreasing to 250 to 300° C. after the heat transfer and 30% of the third-section high-temperature exhaust gas.

It can be seen from the above embodiments that the present disclosure improves circulation and oxygen feeding methods of exhaust gas. The heat can be fully used and recycled to greatly increase the heat utilization rate, and non-uniform mixing of the liquid nitrogen wash tail gas with the air can also be avoided to prevent the explosion hazard.

The above describes only the preferred embodiments of the present disclosure. It should be noted that those of ordinary skill in the art can further make several improvements and retouches without departing from the principles of the present disclosure. These improvements and retouches shall all fall within the protection scope of the present disclosure.

What is claimed is:

1. A graded oxygen regulating, explosion preventing and recycling method for liquid nitrogen wash tail gas, comprising the following steps:

(a) liquid nitrogen wash tail gas entering a first-section heat exchanger (2) through a cold inlet (2-1) for heat exchange with first-section high-temperature exhaust gas from a bottom outlet (1-1-2) of a first-section catalytic combustion region 1-1; after the heat exchange, the liquid nitrogen wash tail gas entering a top inlet (1-1-1) of the first-section catalytic combustion region (1-1) through a heat outlet (2-2) and undergoing, in a layer-by-layer manner, first-section catalytic reaction on multiple layers of catalysts that are disposed in the first-section catalytic combustion region (1-1) at intervals to obtain first-section high-temperature exhaust gas, wherein in the process of layer-by-layer first-section catalytic reaction, the liquid nitrogen wash tail gas is mixed with air from an air flow guide pipe (6) above each layer of catalyst, and the first-section catalytic reaction is oxygen-deficient reaction;

(b) discharging the first-section high-temperature exhaust gas from the bottom outlet (1-1-2) of the first-section catalytic combustion region (1-1) to a first-section heat exchanger (2) through a heat inlet (2-3) for heat exchange; after the heat exchange, the first-section high-temperature exhaust gas entering a top inlet (1-2-1) of a second-section catalytic combustion region (1-2) through a cold outlet (2-4) of the first-section heat exchanger (2) and undergoing, in a layer-by-layer manner, second-section catalytic reaction on multiple layers of catalysts that are disposed in the second-section catalytic combustion region (1-2) at intervals to obtain second-section high-temperature exhaust gas, wherein in the process of layer-by-layer second-section catalytic reaction, the first-section high-temperature exhaust gas is mixed with air from the air flow guide pipe (6) above each layer of catalyst, and the second-section catalytic reaction is oxygen-deficient reaction;

(c) discharging the second-section high-temperature exhaust gas from a bottom outlet (1-2-2) of the second-section catalytic combustion region (1-2) to a second-section heat exchanger (3) through a heat inlet (3-3) for heat exchange with low-temperature exhaust gas discharged through a low-temperature exhaust gas outlet (4-1) of a pulverized coal drying section (4) in the second-section heat exchanger (3); after the heat exchange, discharging the low-temperature exhaust gas through a heat outlet (3-2) of the second-section heat exchanger (3) to the pulverized coal drying section (4) via a hot exhaust gas inlet (4-2), partially discharging the low-temperature exhaust gas through an exhaust gas discharge port (4-3); after the heat exchange, discharging the second-section high-temperature exhaust gas through a cold outlet (3-4) of the second-section heat exchanger (3) to a top inlet (1-3-1) of a third-section catalytic combustion region (1-3) for third-section catalytic reaction on a catalyst of the third-section catalytic combustion region (1-3) to obtain third-section high-temperature exhaust gas, wherein in the process of third-section catalytic reaction, the second-section high-temperature exhaust gas is mixed with air from the air flow guide pipe (6) above the catalyst of the third-section catalytic combustion region (1-3), and the third-section catalytic reaction is oxygen-rich reaction;

(d) discharging the third-section high-temperature exhaust gas through a bottom outlet (1-3-2) of the third-section catalytic combustion region (1-3) to a boiler (5-1) via a heated gas inlet (5-1-1), transferring heat to soft water in a steam pocket (5-2) through the boiler (5-1), and delivering out medium-pressure steam formed from the soft water for use, wherein after transferring the heat, the third-section high-temperature exhaust gas is discharged from a heated gas outlet (5-1-2) of the boiler (5-1) to the pulverized coal drying section (4) via the hot exhaust gas inlet (4-2).

2. The method according to claim 1, wherein the third-section high-temperature exhaust gas enters the pulverized coal drying section (4) via the hot exhaust gas inlet (4-2) after being discharged from the bottom outlet (1-3-2) of the third-section catalytic combustion region (1-3).

3. The method according to claim 1, wherein the temperature of the first-section high-temperature exhaust gas in the step (a) is 450 to 480° C., and the temperature of the liquid nitrogen wash tail gas rises to 230 to 240° C. after the heat exchange.

4. The method according to claim 1, wherein the temperature of the first-section high-temperature exhaust gas after the heat exchange in the step (b) drops to 220 to 240° C., and the temperature of the second-section high-temperature exhaust gas is 450 to 480° C.

5. The method according to claim 1, wherein the temperature of the low-temperature exhaust gas in the step (c) is 90 to 100° C.; the temperature of the low-temperature exhaust gas after the heat exchange rises to 150 to 180° C.; the temperature of the second-section high-temperature exhaust gas after the heat exchange drops to 300 to 350° C.; the temperature of the third-section high-temperature exhaust gas is 550 to 650° C.; and the volume content of $O_2$ in the third-section catalytic reaction is 3 to 4%.

6. The method according to claim 1, wherein the temperature of the third-section high-temperature exhaust gas after the heat transfer in the step (d) drops to 250 to 300° C.

7. The method according to claim 1, wherein the oxygen content in the pulverized coal drying section (4) in the step (c) and the step (d) is less than or equal to 38, and the total content of CO and $H_2$ is less than 200 ppm.

8. The method according to claim 1, wherein the volume content of $O_2$ in the first-section catalytic reaction and the second-section catalytic reaction is independently 0.4 to 0.9%.

9. The method according to claim 8, wherein the temperature of the first-section high-temperature exhaust gas in the step (a) is 450 to 480° C., and the temperature of the liquid nitrogen wash tail gas rises to 230 to 240° C. after the heat exchange.

10. The method according to claim 8, wherein the temperature of the first-section high-temperature exhaust gas after the heat exchange in the step (b) drops to 220 to 240° C., and the temperature of the second-section high-temperature exhaust gas is 450 to 480° C.

* * * * *